US006406325B1

(12) United States Patent
Chen

(10) Patent No.: US 6,406,325 B1
(45) Date of Patent: Jun. 18, 2002

(54) CONNECTOR PLUG FOR NETWORK CABLING

(75) Inventor: Michael Chen, Taipei (TW)

(73) Assignee: Surtec Industries Inc., Taipei (TW)

( * ) Notice: Subject to any disclaimer, the term of this patent is extended or adjusted under 35 U.S.C. 154(b) by 0 days.

(21) Appl. No.: 09/749,394

(22) Filed: Dec. 28, 2000

(51) Int. Cl.[7] ..... H01R 4/24
(52) U.S. Cl. ..... 439/418; 439/941; 439/344
(58) Field of Search ..... 439/418, 676, 439/941, 344

(56) References Cited

U.S. PATENT DOCUMENTS 5,571,035 A * 11/1996 Ferrill ..... 439/894
5,888,100 A * 3/1999 Bofill et al. ..... 439/676
6,080,007 A * 6/2000 Dupuis et al. ..... 439/418
6,238,235 B1 * 5/2001 Shavit et al. ..... 439/418
6,250,949 B1 * 6/2001 Lin ..... 439/418

* cited by examiner

*Primary Examiner*—P. Austin Bradley
*Assistant Examiner*—Ross Gushi
(74) *Attorney, Agent, or Firm*—Birch, Stewart, Kolasch & Birch, LLP

(57) ABSTRACT

An electrical connector plug applicable to connectors for high speed communication cabling is disclosed. The plug includes a spacer mounted in the case. The spacer is formed with a plurality of grooves for guiding the communication lines in specific positions before linking to metal plates of connecting pins. The communication lines are guided to form a capacitance effect from different position levels. That is, the first, third, sixth and seventh lines are separated from the second, fourth, fifth and eighth lines at top and bottom sides of the spacer, so as to reduce interference of signals in the lines, and improve the communication performance.

4 Claims, 5 Drawing Sheets

CONNECTOR PLUG FOR NETWORK CABLING

BACKGROUND OF THE INVENTION

1. Field of Invention

The present invention generally relates to an electrical connector applied to transmit electrical signals, and more particularly relates to an electrical connector plug applicable to connectors of high speed communication cabling.

2. Related Art

Information transmissions through network communication are recently more and more popular. The applications are getting wider. As a demand, the high speed and high efficiency transmissions require high quality cabling and connectors. Generally, the network communication paths are composed of transmission media and electrical connectors. On the transmission media, there are twisted pair cables, coaxial cables, and optical fibers. There are a certain defects, such as near-end cross talk and return loss, occurred in the communication paths which will get worsen as the frequency of signals getting higher.

For the aforesaid reason, the EIA/TIA 568 standard established by Electronic Industries Association has been adopted into IEEE 802.3u standard by the Institute of Electrical and Electronics Engineers, Inc.. The IEEE 802.3u standard includes all the standards for the transmission media and connectors, and classifies them into several categories. For example, "Category 3" is network cabling for voice, which uses solid cooper wires of 24AWG with impedance 100Ω and certifies UTP for data transmission up to 10 Mbps; "Category 4" is the same as Category 3 but with bandwidth of 16 Mbps; "Category 5" is the same as Category 3 but with bandwidth of 100 Mbps. Another category with tighter requirements than Category 5 is "Category 5e" which requests for a limited extent of return loss caused by reflections in the communication system due to the discontinuous impedance.

In order to prevent attenuation in high-speed communication, the standards are established, but all concern to transmission media and connectors. No limitation for connector plug is described. But, high-speed communication requires a total solution, any point in the system should be free from defect. The reason why the connector plug hasn't been requested in standard is that the plugs are usually manually installed. There are variations of manual operation that cause uncertainty hard to be requested as standards. In order to accommodate with requirements of connectors of Category 5e, the following requirements are used practically as control target of connector plug:

| Line pairs | Near-end cross talk (dB) Category 5e @ 100 MHZ |
|---|---|
| 1-3 | 34.4–37.6 |
| 3-2 | 42–50 |
| 3-4 | 42–50 |
| 1-2 | ≧50 |
| 1-4 | ≧50 |
| 2-4 | 60 |

Interference that causes attenuation of transmission comes from cross talk of the eight communication lines located in parallel and in a same plane. The interference of the parallel lines badly influences the communication quality. There have been prior arts to solve the problem of decreased performance in transmitting higher frequency signals. For example, using guide blades to separate the first pair, the second and fourth pairs, and the third pair into three different planes; and further utilizing metallic conductors to enhance the compensation effect. Though the construction may theoretically meet aforesaid requirements, it is still affected by manual assembly deviation, and the following defects also exist:

1) Interference still exists because the pairs of communication lines are still in parallel;
2) Several guide blades and conductors are used, which increase the cost;
3) Since the communication lines are separated into three planes, the metallic pins for connecting the lines have to be of three shapes, which will increase the cost, and cannot be used with a single kind;
4) The guide blades have to be furnished with holes for receiving the communication lines. The assembly is therefore bothersome.

SUMMARY OF THE INVENTION

It is therefore an object of the present invention to provide an electrical connector plug applicable to connectors for high speed communication cabling. The connector plug can lower the manufacturing cost, reduce the assembly deviation by an open-type assembly of communication lines, and improve the successful manufacture conforming to the requirements.

To achieve the aforesaid object, an electrical connector plug applicable to connectors for high speed communication cabling includes a spacer mounted in the case. The spacer is formed with a plurality of grooves for guiding the communication lines in specific positions before linking to the metal plates. The communication lines are guided to form a capacitance effect from different position levels. That is, the first, third, sixth and seventh lines are separated from the second, fourth, fifth and eighth lines at top and bottom sides of the spacer, so as to reduce interference of signals in the lines, and improve the communication performance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
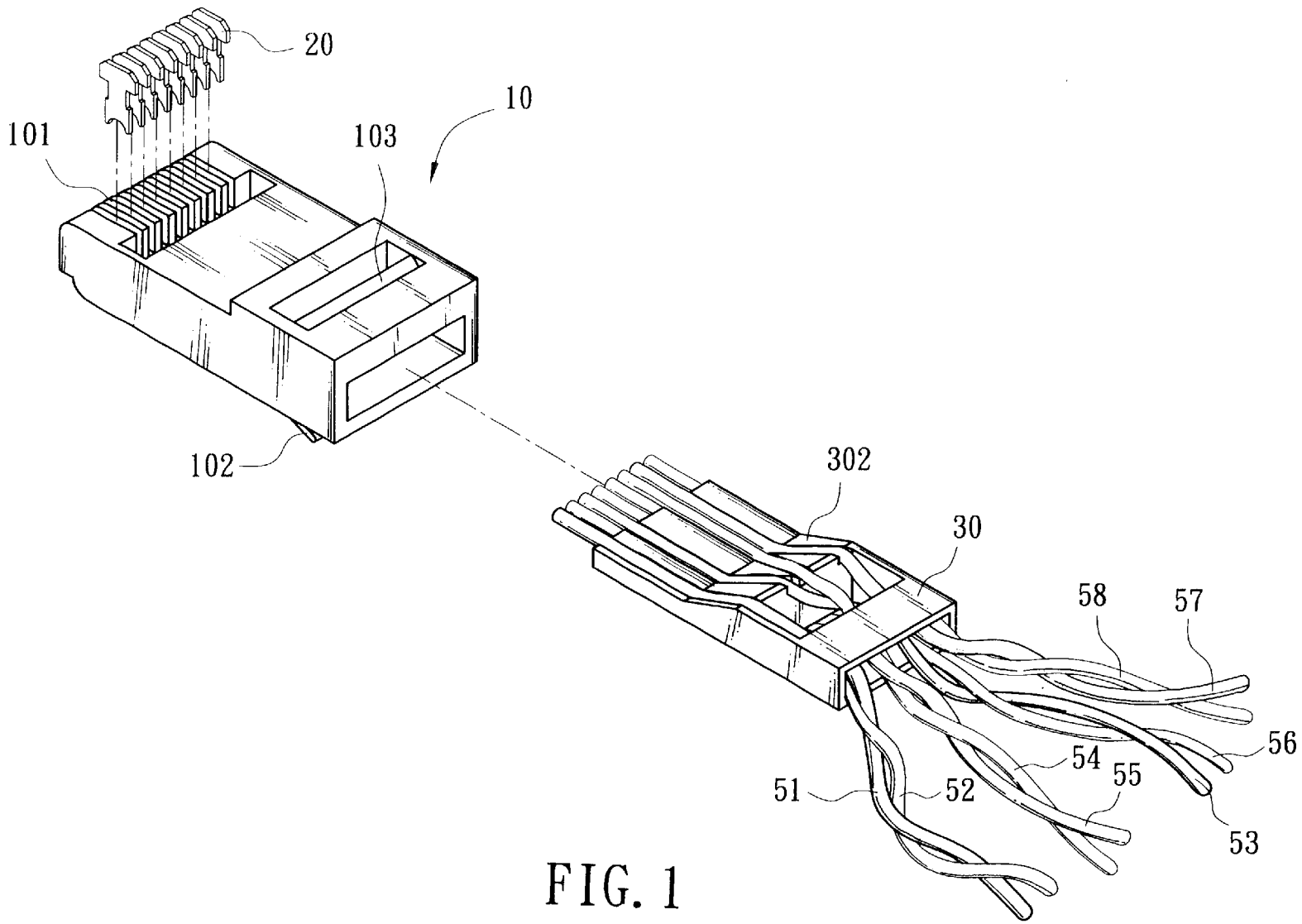
FIG. 1 is an exploded view of the present invention.

As shown in FIG. 1, an electrical connector plug applicable to connectors for high-speed communication cabling according to the present invention includes a spacer 30 mounted in the case 10. The spacer 30 guides the communication lines 51~58 in specific positions before they link to the metal plates 20. The communication lines are guided to form a capacitance effect from different position levels. The case 10 includes eight grooves 101 formed at the front end for mounting the metal plates 20; a latch 102 formed near the rear end for being fixed with a connector when being used; and a lock portion 103 for fixing the lines 51~58 in place after assembly. The metal plates 20 will pierce the communication lines 51~58 after pressing into the grooves 101 and electrically connect with the lines 51~58.

Figure 2:
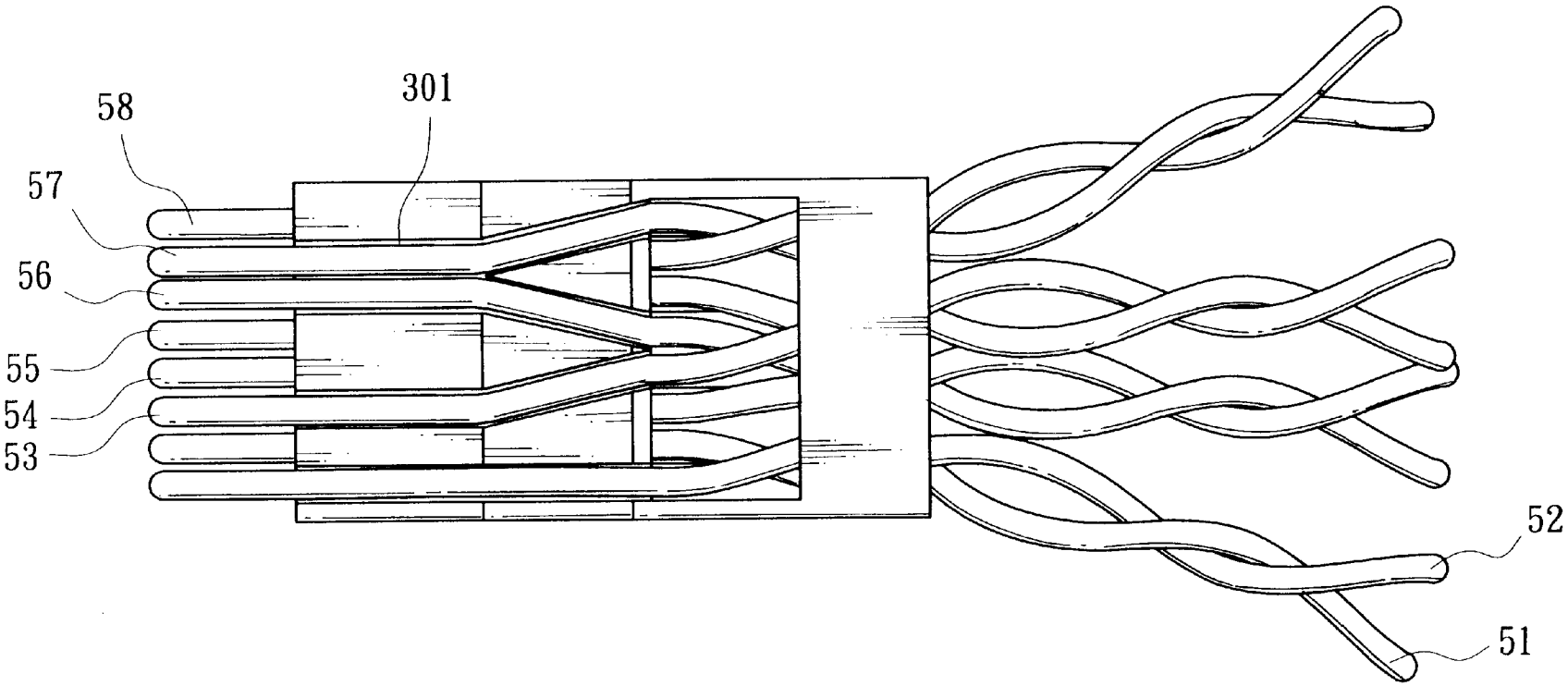
FIG. 2 is a top view of a spacer in the present invention.
Figure 3:
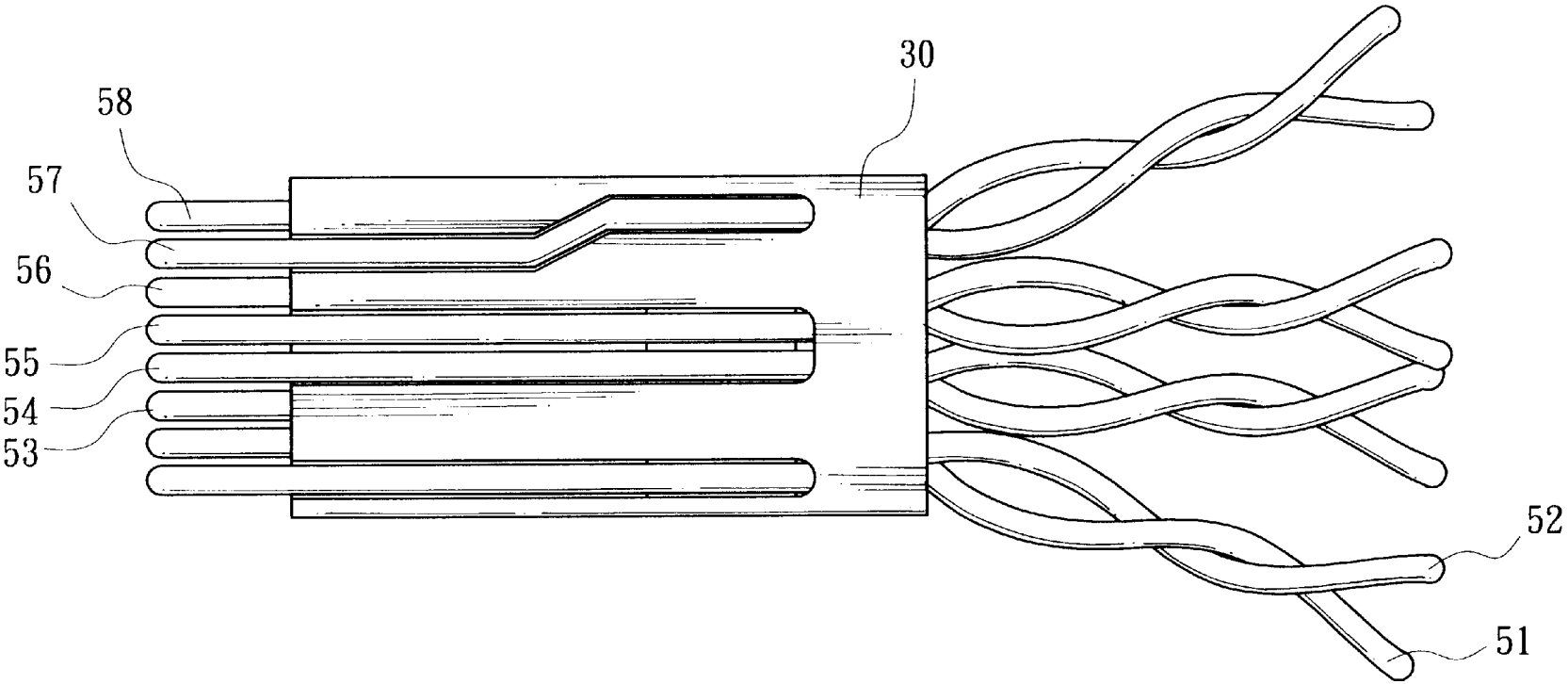
FIG. 3 is a bottom view of a spacer in the present invention.

Taking cabling of EIA/TIA T568B for example, the communication lines 51~58 are the first, second, third, fourth, fifth, sixth, seventh and eighth line respectively. And, the fourth and fifth lines are the first pair of communication lines; the first and second lines 51, 52 are the second pair; the third and sixth lines 53, 56 are the third pair; while the seventh and eight lines are the fourth pair. As shown in FIGS. 2 and 3, the spacer 30 separates the lines 51, 53, 56 and 57 to the top side of the spacer 30 and separates the lines 52, 54, 55 and 58 to the bottom side of spacer 30.

That is, the first, second, sixth and seventh lines are separated from the second, fourth, fifth and eighth lines at upper and lower sides of the spacer, so as to reduce interference of signals in the lines, and improve the communication performance.

As shown in FIGS. 2 and 3, the top view and bottom view of the spacer 30, there is a slope 302 formed on the spacer 30. A plurality of grooves 301 are formed on both side of the spacer 30. The grooves 301 are not in parallel to each other. The grooves 301 on the topside are formed to guide the lines 51, 53, 56 and 57, while the grooves 301 on the bottom side are formed to guide the lines 52, 54, 55 and 58. The different grooves 301 prevent the lines from parallel in horizontal plane, and the slope 302 prevents the lines from parallel in vertical plane.

A connector plug according to the present invention can fulfill the requirements. A test result is listed below.

| Line pairs | Near-end cross talk (dB) Category 5e @ 100 MHZ |
|---|---|
| 1-3 | 36.69 |
| 3-2 | 47.41 |
| 3-4 | 45.57 |
| 1-2 | 60.5 |
| 1-4 | 63.72 |
| 2-4 | 72.03 |

Figure 4A:
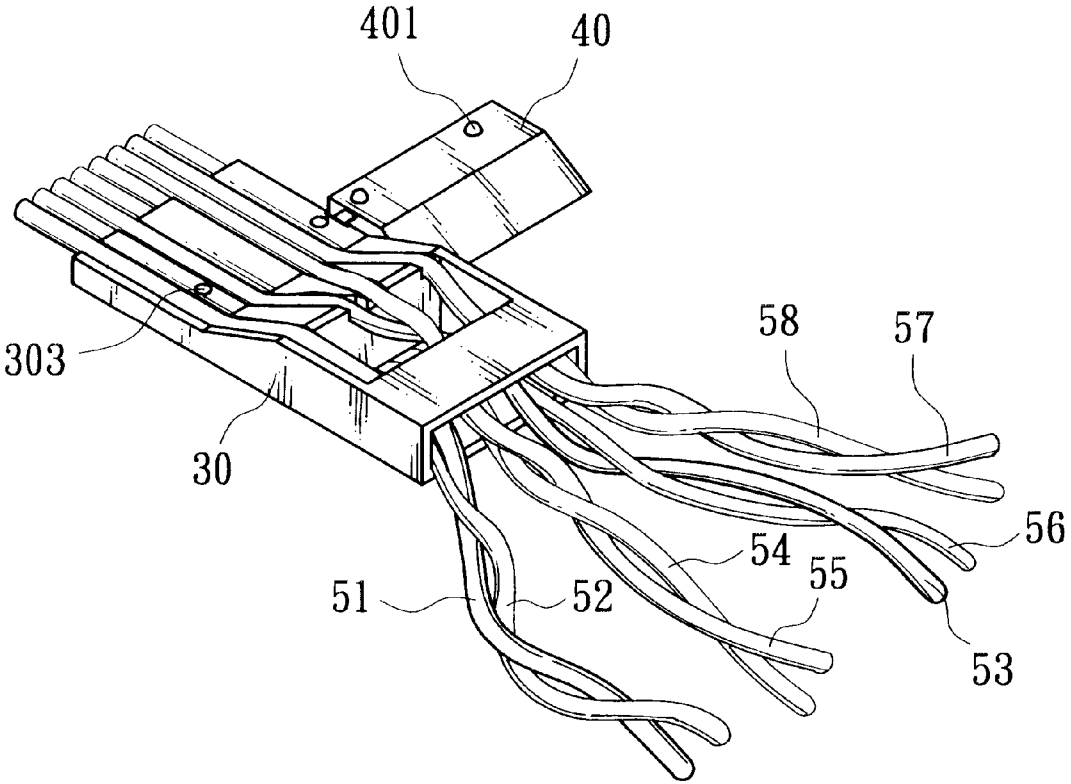
FIGS. 4A and 4B are embodiments of a cover included in the present invention.
Figure 4B:
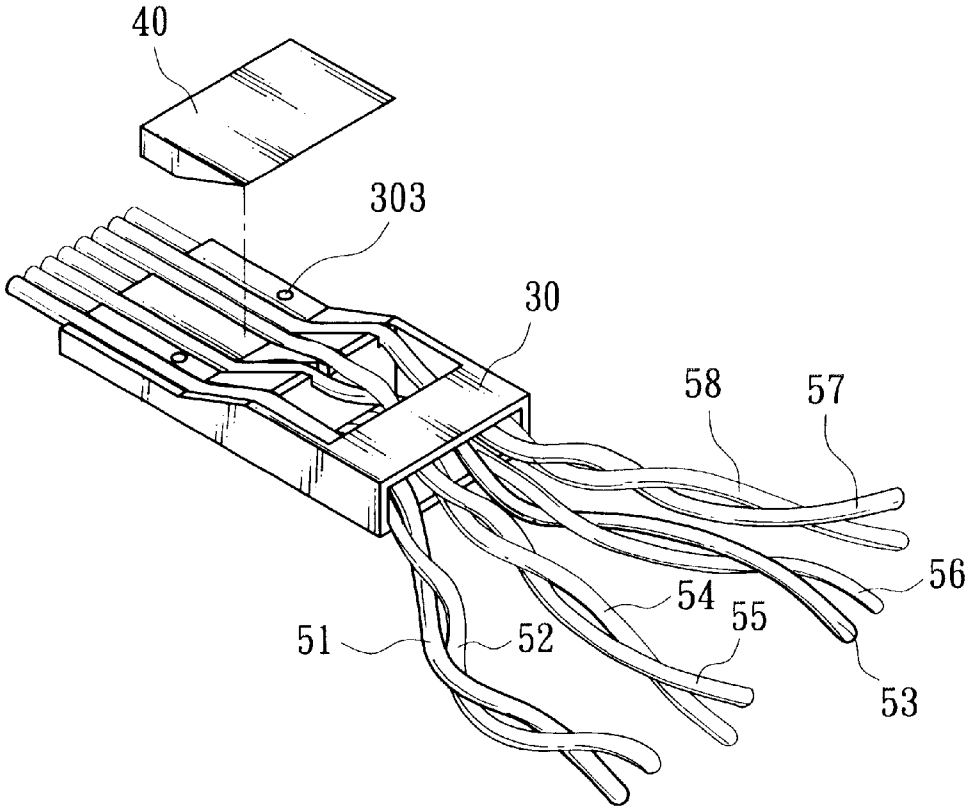

In embodiments of the present invention, there is further a cover for pressing the lines 51~58 in place during assembly. In FIG. 4A, a first embodiment of the cover 40 is shown. The cover 40 can be fixed on the spacer 30 through couples of extrusions 401 and holes formed on the cover 40 and spacer 30 respectively. The cover, made of plastic, is molded in conjunction with the spacer 30, and can be bent over to cover in place. Of course, the cover 40 can be separately made as shown in FIG. 4B.

To assemble the connector plug, the communication lines 51~58 are first put into grooves 301, then fixed by the cover 40. The spacer 30 with lines 51~58 is then inserted into the case 10. Further, the metal plates 20 are pressed to pierce into the lines 51~58. And, finally, the lock portion 103 is pressed down to hold the lines 51~58 firmly in place. The assembly is simple and stable that high quality can be obtained.

The electrical connector plug according to the present invention has the following advantages:

1) a one piece spacer can reduce the cost;

2) an open-type line assembly makes the manufacture easy and of less failure rate;

3) the metal plates are of a common shape that is usually used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical connector plug applicable to connectors for communication cabling comprising:

a case, having one end formed with a plurality of slots, and another portion formed with a latch for fixing with said connectors;

a plurality of metal plates with the same length, to be mounted into said plurality of slots, for electrically linking to a plurality of communication lines located in a same plane;

a spacer, to be mounted into said case, formed with a slope and a plurality of grooves for guiding said communication lines in specific positions before linking to said metal plates, so that, the first, third, sixth and seventh lines are separated from the second, fourth, fifth and eighth lines at top and bottom sides of said spacer, so as to reduce interference of signals in said lines via a capacitance effect from different position levels; and a cover mounted on said spacer, for fixing said communication lines in place, wherein said cover is linked on one side of the spacer, and rotatively movable for mounting to said spacer.

2. The electrical connector plug as recited in claim 1 wherein at least some of said plurality of grooves formed on said spacer are not in parallel to each other.

3. The electrical connector plug as recited in claim 1 wherein said slope prevents at least some of said lines from being parallel in a vertical plane.

4. The electrical connector plug as recited in claim 1 wherein said cover is connected to said spacer via extrusions and holes formed respectively on the two.

* * * * *